United States Patent [19]

Wolter

[11] 4,116,025

[45] Sep. 26, 1978

[54] REVERSIBLE FLAT KEY FOR CYLINDER LOCKS

[75] Inventor: Heinz Wolter, Kürten, Fed. Rep. of Germany

[73] Assignee: DOM-Sicherheitstechnik GmbH & Co. KG, Brühl, Fed. Rep. of Germany

[21] Appl. No.: 859,372

[22] Filed: Dec. 12, 1977

[30] Foreign Application Priority Data

Dec. 23, 1976 [DE] Fed. Rep. of Germany ..... 2658495

[51] Int. Cl.[2] ..... E05B 19/04; E05B 27/06

[52] U.S. Cl. ..... 70/358; 70/406; 70/409

[58] Field of Search ..... 70/358, 364 A, 378, 70/401, 406, 407, 409, 419, 421

[56] References Cited

U.S. PATENT DOCUMENTS

| | | | |
|---|---|---|---|
| 3,742,744 | 7/1973 | Lumme | 70/358 |
| 3,974,670 | 8/1976 | Wolter | 70/364 A |

*Primary Examiner*—Robert L. Wolfe

*Attorney, Agent, or Firm*—Martin A. Farber

[57] ABSTRACT

A reversible flat key for cylinder locks having recesses arranged in opposite wide faces of the key for arranging the tumbler pins in the proper position and having lead-in bevels in the region of the tip of the key, which lead-in bevels lie in alignment with the respective row of recesses and each of which runs down obliquely into the respective opposite wide face of the key. Each lead-in bevel runs out into the rear face of the rib projecting up above the wide face of the key and carrying the recesses and at least one recess has a greater depth than the height of the rib.

4 Claims, 5 Drawing Figures

REVERSIBLE FLAT KEY FOR CYLINDER LOCKS

The invention refers to a reversible flat key for cylinder locks having recesses arranged in opposite wide faces of the key for arranging the tumbler pins in the proper position and having lead-in bevels in the region of the tip of the key, which lead-in bevels lie in alignment with the respective row of recesses and each of which runs down obliquely into the respective opposite wide face of the key.

A reversible flat key of that kind is known from the Federal Republic of Germany Auslegeschrift No. 2,344,473. Insertion of the reversible flat key into the key channel is dependent upon the tip of the key and the arrangement or bringing of the tumbler pins into the proper order or position by the correct recesses. With respect to permutation, limits are imposed since this is dependent upon the number of pins, the thickness of the reversible flat key and the increment required of such cylinder locks.

It is an object of the invention to provide a reversible flat key of the assumed type which for increasing the security against burglary, with the number of recesses remaining the same and without alteration of the increment has an increased permutation.

This problem is aided in its solution if each lead-in bevel runs out into the rear face of a rib projecting up above the wide face of the key and carrying the recesses and at least one recess has a greater depth than the height of the rib.

Because of such a design a reversible flat key in accordance with the introductory mentioned species is created, which particularly contributes to an increased security against burglary. The ribs which project up above the wide face of the key fulfil a double function. On the one hand they serve to mask the profile of the key and on the other hand they serve to receive the recesses. Consequently a greater dimension is available for the recesses than the thickness of the key itself amounts to, so that an increased permutation can be achieved without reducing the increment or increasing the number of recesses. In spite of this rib, an easy insertion of the key is guaranteed, since the lead-in bevels run out into the rear or back face of the corresponding rib. The solution in accordance with the invention also provides the advantage of increased stability and rigidity of the shank of the key. Higher locking forces therefore may be transmitted by means of the reversible flat key without danger.

An advantageous construction of the invention is such that each wide face of the key, on the side thereof opposite to the rib, has supplementary recesses aligned flush with this rib, for bringing springless supplementary pins into the correct position, which supplementary recesses are arranged offset in the longitudinal direction with respect to the recesses in the rib arranged on the opposite wide face of the key and which lie in a row on a web section formed by longitudinal grooves on both sides of the web section, and the corresponding lead-in bevel runs into the peak area of the web section. In this way the recesses and supplementary recesses can be provided on the shank of the key unimpeded. The offset arrangement of the recesses and supplementary recesses moreover allows the recesses to be able to reach as far as the opposite wide face of the key.

Finally it is of further advantage that at least the incoming or entrance section of the lead-in bevels has a fluted surface. This is adjusted complementarily to the points of the tumbler pins in order to guarantee a trouble-free insertion of the reversible flat key.

With the above and other objects and advantages in view, the present invention will become more clearly understood in connection with the following detailed description of a preferred embodiment, when considered with the accompanying drawings, of which:

Figure 1:
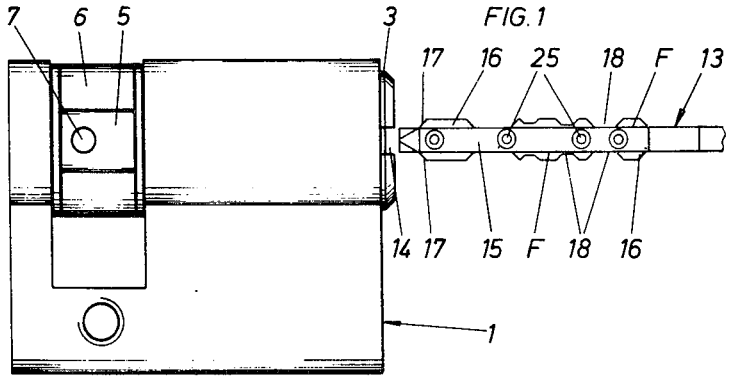
FIG. 1 is an enlarged elevational view of a cylinder lock with a reversible flat key in accordance with the invention.
Figure 2:
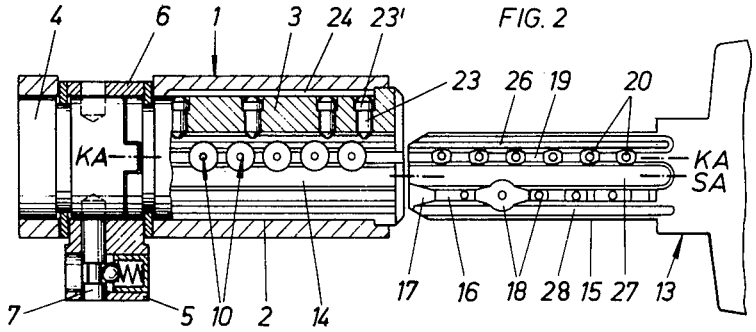
FIG. 2 is a horizontal section through the cylinder lock in the region of the key channel and the plan view of the one wide face of the key.

The cylinder lock has a profiled cylinder-housing 1. The cylinder core 3 is arranged rotatably in the latter in a bore 2 therein. The cylinder core 3 is connected to the coupling member 4 which carries the ward hub 6 exhibiting the ward 5. The coupling connection is produced by means of the radial pin 7.

The cylinder housing 1 and the cylinder core 3 have bores 8, 9 disposed in alignment with one another, which bores receive tumbler pins 10. The bores 8 in the cylinder housing 1 receive the housing pins 10' and the aligned bore 9 in the cylinder core 3 receives the core pins 10'' which are provided with a point 11. The tumbler pins 10 are spring-loaded in the direction of the cylinder core 3 by means of pin springs 12.

The cylinder core 3 has a key channel 14 which is asymmetrically disposed with respect to the core axis KA, and which serves to receive the reversible flat key 13. Symmetrically with respect to the key axis SA, the reversible flat key has on its key shank 15 on each wide face F of the key a rib 16 projecting thereabove. With the reversible flat key 13 pushed into the key channel 14, the core axis KA lines up with one of the two ribs 16.

Figure 5:
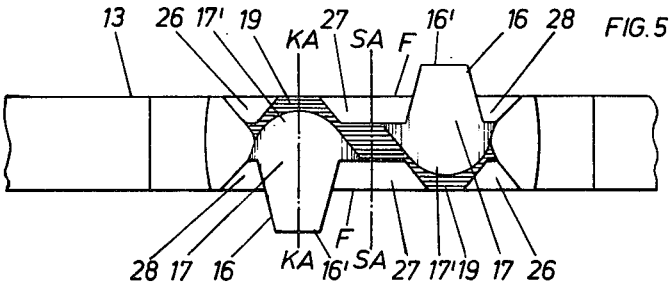
FIG. 5 is an end elevation of the tip of the key.

A lead-in bevel 17 beginning at each wide face of the key starts out at its entrance section 17' from the tip of the key, and extends and runs out onto the rear face 16' of the rib 16 which lies on the opposite wide face of the key. As may be seen in particular from FIGS. 3 and 5, the entrance section 17' of the lead-in bevel 17 has a fluted surface. The fluting is adjusted complementarily to the points 11 of the tumbler pins 10.

Figure 3:
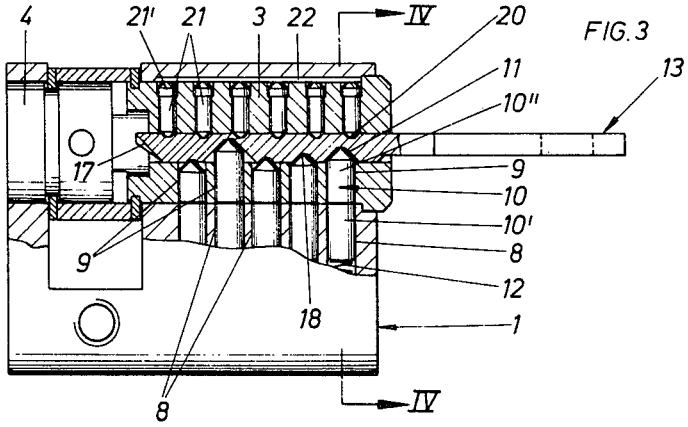
FIG. 3 is a partial longitudinal section through the cylinder lock with the reversible flat key introduced therein.
Figure 4:
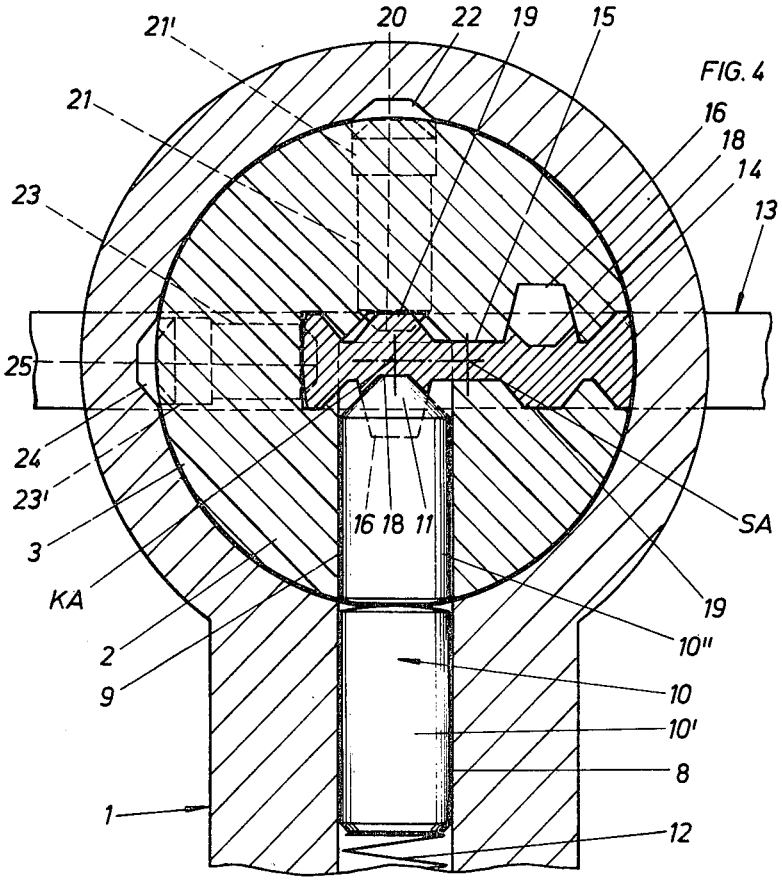
FIG. 4 is a section along the line IV—IV in FIG. 3.

Each rib 16 has a row of recesses 18 of different depths. FIGS. 3 and 4 show that the recesses 18 can have a greater depth than the height of the ribs 16 projecting beyond the wide face F of the key. The increment can be dimensioned large as a consequence of the considerable recess or drill depth.

Opposite and in alignment with each rib 16 on the other wide face of the key is a web section 19, the lead-in bevel 17 starting at the entrance section 17' running into its peak or top area. Each web section 19 contains a row of supplementary recesses 20 which serve to bring springless supplementary pins 21 (i.e., the latter not having springs) into the correct position in the cylinder core 3. FIG. 3 indicates that the supplementary recesses 20 are arranged offset in the longitudinal direction with respect to the recesses 18 in the rib 16 arranged on the opposite wide face of the key. Consequently the springless supplementary pins 21 are arranged offset with respect to the tumbler pins 10. The springless supplementary pins 21 are equipped with heads 21' which restrict or limit the inward displacement of the supplementary pins. The heads 21' cooperate with a longitudinal groove 22 in the cylinder housing 1.

Further, in the cylinder core 3 in a position offset 90 degrees with respect to the supplementary pins 21, there are provided additional supplementary pins 23, the heads 23' of which cooperate with the longitudinal groove 24 in the side of the housing. Supplementary recesses 25 which lie on the narrow face of the shank 15 of the key are coordinated to the supplementary pins 23.

The web section 19 is formed by longitudinal grooves 26 and 27 provided on both sides of the supplementary recesses 20. A further groove 28 extends along one of the longitudinal edges of each rib 16. The profiling of the key channel 14 is adjusted complementary to this profiling of the shank 15 of the key, so that only the appropriately shaped reversible flat key can be inserted.

The reversible flat key 13 inserted in the key channel 14 in FIG. 3 has the tumbler pins 10 and the supplementary pins 21 and 23 brought into the correct position in such a way that subsequent turning of the cylinder core 3 is possible.

I claim:

1. A reversible flat key for cylinder locks having rows of recesses arranged in opposite wide faces of the key for bringing tumbler pins of the cylinder lock into the correct position, comprising a flat key having opposite wide faces and a tip, a rib formed on each of said wide faces of the key projecting thereabove defining a rear face, said rib being formed with a plurality of recesses constituting a row of recesses, said key is formed with lead-in bevels in the region of said tip of the key in alignment with a respective of said row of recesses, each of said lead-in bevels extends inclined into the respective of said opposite wide faces of the key, each of said lead-in bevels runs out into said rear face of said rib projecting above the corresponding each of said wide faces of the key and carrying said recesses, and at least one of said recesses has a greater depth than the height of said rib.

2. The reversible flat key as set forth in claim 1, wherein each of said wide faces of the key on a wide face side of the key opposite to said rib is formed with supplementary recesses in alignment with said rib and adapted to bring springless supplementary pins of the cylinder lock into the correct position, said supplementary recesses are arranged offset in the longitudinal direction of the key relative to said recesses in said rib arranged on the wide face of the key opposite to said side having said supplementary recesses, a web section having a peak area on said wide faces of the key, respectively, said key is formed with two longitudinal grooves on each of said wide faces of the key spaced apart from each other on both sides of said web section, respectively, said web section is formed by and between said two longitudinal grooves, said supplementary recesses are formed in said web section aligned in a row, and said lead-in bevel which runs out into said rear face of said rib starts from said tip of the key running into the peak area of said web section.

3. The reversible flat key as set forth in claim 1, wherein each of said lead-in bevels has an entrance section at said tip of the key, at least said entrance section of each of said lead-in bevels is formed with a fluted surface.

4. The reversible flat key as set forth in claim 2, wherein said peak area of said web section is aligned with a corresponding said wide face of the key.

* * * * *